US012654216B2

(12) United States Patent
Funk et al.

(10) Patent No.: US 12,654,216 B2
(45) Date of Patent: Jun. 16, 2026

(54) SHEET METAL COINING METHOD UTILIZING BILATERAL COIN PUNCHING

(71) Applicant: Schaeffler Technologies AG & Co. KG, Herzogenaurach (DE)

(72) Inventors: Seth Funk, Wooster, OH (US); Raymond Imars, Ashland, OH (US); Timothy Simon, Wooster, OH (US); Richard Boyer, Wooster, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 260 days.

(21) Appl. No.: 18/127,490

(22) Filed: Mar. 28, 2023

(65) Prior Publication Data

US 2024/0326116 A1 Oct. 3, 2024

(51) Int. Cl.
*B21D 22/06* (2006.01)

(52) U.S. Cl.
CPC ..... *B21D 22/06* (2013.01)

(58) Field of Classification Search
CPC ..... B21D 22/04; B21D 22/06; B21J 5/025; B21J 5/08; B21J 9/06; B21J 7/14; B21J 13/02
See application file for complete search history.

(56) References Cited

U.S. PATENT DOCUMENTS

2006/0288754 A1* 12/2006 Otaki ..... B21J 5/02 72/325
2020/0360984 A1* 11/2020 Okubo ..... F16C 3/06

FOREIGN PATENT DOCUMENTS

JP 2581190 B2 * 2/1997 ..... B21K 1/763
WO WO-2015146879 A1 * 10/2015 ..... B21J 5/025

* cited by examiner

*Primary Examiner* — Debra M Sullivan
(74) *Attorney, Agent, or Firm* — Davidson Kappel LLC

(57) ABSTRACT

A method of coining a metal part includes positioning the metal part between an upper die and a lower die, an upper punch being positioned within the upper die, a lower punch being positioned within the lower die; and punching an upper surface of the metal part with the upper punch to cause an upper portion of the metal part to deform into a concave surface of the upper die, and punching a lower surface of the metal part with the lower punch to cause a lower portion of the metal part to deform into a concave surface of the lower die.

17 Claims, 8 Drawing Sheets

SHEET METAL COINING METHOD UTILIZING BILATERAL COIN PUNCHING

TECHNICAL FIELD

The present disclosure relates generally to coining methods and more specifically to coining metals for use in motor vehicle drivetrains.

BACKGROUND

Coining is a cold working process used to manufacture parts by deforming a workpiece into a desired shape and size using high pressure and localized compressive forces.

SUMMARY

A method of coining a metal part is provided. The method includes positioning the metal part between an upper die and a lower die, an upper punch being positioned within the upper die, a lower punch being positioned within the lower die; and punching an upper surface of the metal part with the upper punch to cause an upper portion of the metal part to deform into a concave surface of the upper die, and punching a lower surface of the metal part with the lower punch to cause a lower portion of the metal part to deform into a concave surface of the lower die.

In examples, the upper die includes a recess formed in a lower surface of the upper die, the recess of the upper die including a first surface contacting the upper surface of the metal part, the recess of the upper die also including the concave surface; and the lower die includes a recess formed in an upper surface of the lower die, the recess of the lower die including a first surface contacting the lower surface of the metal part, the recess of the lower die also including the concave surface.

In examples, the concave surface of the recess in the lower surface of the upper die extends to a flat section of the lower surface of the upper die, and the concave surface of the recess in the upper surface of the lower die extends to a flat section of the upper surface of the lower die. The flat section of the lower surface of the upper die and the flat section of the upper surface of the lower die contact each other as the upper surface of the metal part is contacted with the upper die and the lower surface of the metal part is contacted with the lower die.

In examples, as or after the flat sections of the upper die and the lower die contact each other, a side edge of the metal part is deformed into a contact edge of the lower and upper dies where the flat sections meet each other.

In examples, the upper punch extends into the recess formed in the lower surface of the upper die during the punching step and the lower punch extends into the recess formed in the upper surface of the lower die during the punching step.

In examples, the upper die includes a stepped bore formed therein receiving the upper punch, the upper punch being moved vertically downward in the stepped bore of the upper die during the punching step, and the lower die includes a stepped bore formed therein receiving the lower punch, the lower die being moved vertically downward to cause the stepped bore of the lower die to move with respect to the lower punch during the punching step.

In examples, the upper punch includes a base and a punching arm having a lesser width than the base extending downward from the base, the punching arm of the upper punch deforming the upper surface of the metal part during the punching step; and the lower punch includes a base and a punching arm having a lesser width than the base extending downward from the base. The punching arm of the lower punch deforms the lower surface of the metal part during the punching step.

In examples, the punching arm of the upper punch includes a tip having rounded outer edges, the tip of the punching arm of the upper punch deforming the upper surface of the metal part during the punching step; and the punching arm of the lower punch includes a tip having rounded outer edges, the tip of the punching arm of the lower punch deforming the lower surface of the metal part during the punching step.

In examples, the metal part includes a side edge extending from the upper surface to the lower surface. The upper surface and the side edge defines an upper corner of the metal part, and the lower surface and the side edge defining a lower corner of the metal part. The upper portion of the metal part is deformed into the concave surface of the upper die during the punching step including the upper corner of the metal part, and the lower portion of the metal part is deformed into the concave surface of the lower die during the punching step including the lower corner of the metal part.

In examples, the upper portion of the metal part deformed into the concave surface of the upper die during the punching step further includes part of the side edge of the metal part, and the lower portion of the metal part deformed into the concave surface of the lower die during the punching step includes part of the side edge of the metal part.

In examples, prior to the punching step, the upper corner and the lower corner are defined by approximately right angles and the side edge is approximately perpendicular to the upper surface and the lower surface of the metal, and after the punching step, the side edge has a convex shape.

In examples, the convex shape is a semi-oval shape.

In examples, the upper punch, during the punching step, contacts the upper surface of the metal part and deforms the upper portion of the metal part into the concave surface of the upper die to convert the upper corner into an upper rounded surface; and the lower punch, during the punching step, contacts the lower surface of the metal part and deforms the lower portion of the metal part into the concave surface of the lower die to convert the lower corner into a lower rounded surface.

In examples, during the punching step, the upper punch forms an indentation in the upper surface of the metal part and contact with the concave surface of the upper die shapes the upper rounded surface, and the lower punch forms an indentation in the lower surface of the metal part and contact with the concave surface of the lower die shapes the lower rounded surface.

In examples, a top of the side edge defines an upper peak and the upper surface further includes a downwardly sloped surface section extending from the upper peak to the indentation in the upper surface, and a bottom of the side edge defines a lower peak and the lower surface further includes an upwardly sloped surface section extending from the lower peak to the indentation in the lower surface.

In examples, during the punching step, the concave surface of the upper die contacts the upper corner of the metal part as the upper punch contacts the upper surface of the metal part, and the concave surface of the lower die contacts the lower corner of the metal part as the lower punch contacts the lower surface of the metal part.

In examples, during the punching step, the upper punch contacts the upper surface of the metal part a non-zero lateral distance from the side edge and the lower punch contacts the lower surface of the metal part a non-zero lateral distance from the side edge.

In examples, the upper punch is fixed to an upper support plate that is vertically movable with respect to the upper die and the lower punch is fixed to a lower support plate, the lower die being vertically movable with respect to the lower support plate.

In examples, prior to the punching step the upper support plate is spaced from the upper die and the lower support plate is spaced from the lower die, and at an end of the punching step the upper support plate contacts the upper die and the lower support plate contacts the lower die A metal part formed by the method is also provided.

BRIEF DESCRIPTION OF THE DRAWINGS

The present disclosure is described below by reference to the following drawings, in which.

DETAILED DESCRIPTION

Figure 1:
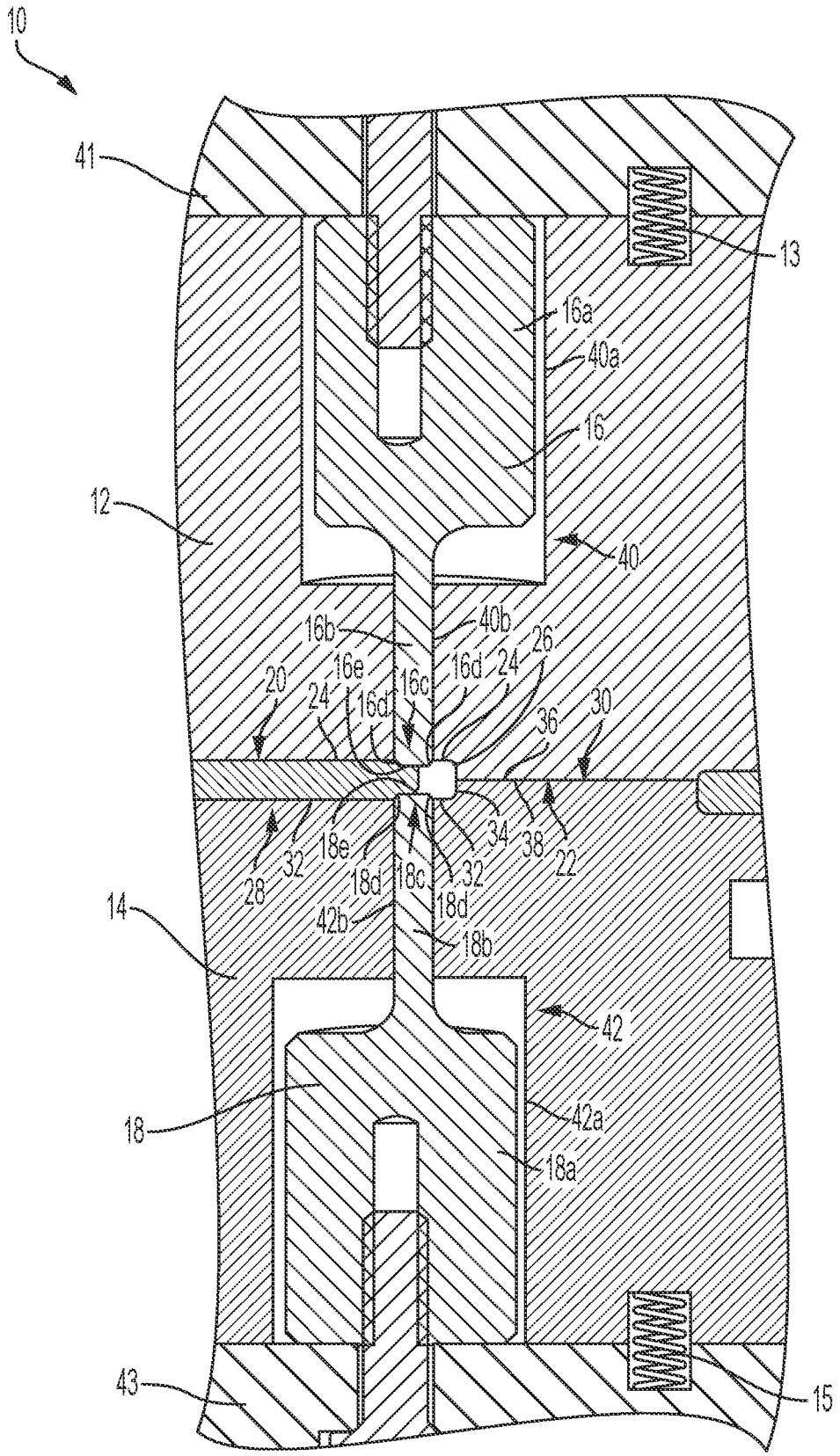
FIG. 1 shows a coining assembly for coining a metal part according to the present disclosure.

FIG. 1 shows a coining assembly 10 for coining a metal part. The coining assembly 10 includes an upper die 12 and a lower die 14, with an upper punch 16 and a lower punch 18 being positioned within the upper die 12 and lower die 14, respectively. The upper die 12 and lower die 14 both travel a distance while being guided by posts and bushings.

The upper die 12 includes a recess 20 formed in a lower surface 22 of the upper die 12. The recess 20 is defined by a first surface 24 for contacting an upper surface of the metal part and a concave surface 26. Similarly, the lower die 14 includes a recess 28 formed in an upper surface 30 of the lower die 14, with the recess 28 including a first surface 32 for contacting the lower surface of the metal part, and a concave surface 34.

The concave surface 26 of the recess 20 in the lower surface 22 of the upper die 12 extends to a flat section 36 of the lower surface 22, and the concave surface 34 of the recess 28 in the upper surface 30 of the lower die 14 extends to a flat section 38 of the upper surface 30. The flat sections 36, 38 of the upper and lower dies 12, 14 are configured to contact each other during coining.

Coining assembly 10 is configured to cause the upper punch 16 to extend into the recess 20 formed in the lower surface 22 of the upper die 12 during the punching step, and to cause the lower punch 18 to extend into the recess 28 formed in the upper surface 30 of the lower die 14 during the punching step. Coining assembly 10 is configured such that the stroke of the dies 12, 14 due to the press closing forces the punches 16, 18 to enter into recesses 20, 28, respectively, The upper die 12 includes a stepped bore 40 formed therein receiving the upper punch 16, with the upper punch 16 being movable vertically downward in the stepped bore 40 of the upper die 12 during a coining operation. The lower die 14 includes a stepped bore 42 formed therein receiving the lower punch 18, with the stepped bore 42 being movable vertically downward to cause the stepped bore 42 of the lower die 14 to move with respect to lower punch 18 during a coining operation. Upper punch 16 is fixed to an upper support plate 41 that is vertically movably attached to upper die 12 by a spring 13. Lower punch 18 is fixed to a lower support plate 43, and lower die 14 is vertically movably attached to lower die 14 by a spring 15. A coining operation begins with each of plates 41, 43 being spaced from the respective die 12, 14, and ends with each of plates 41, 43 contacting the respective die 12, 14.

Stepped bore 40 includes an upper wider section 40*a* receiving a base 16*a* of upper punch 16 and a lower narrower section 40*b* receiving an arm 16*b* of upper punch 16. Bore 40, via narrower section 40*b*, intersects first surface 24. Similarly, stepped bore 42 includes an upper wider section 42*a* receiving a base 18*a* of lower punch 18 and a lower narrower section 42*b* receiving an arm 18*b* of lower punch 18. Bore 42, via narrower section 42*b*, intersects first surface 32.

Figure 5B:
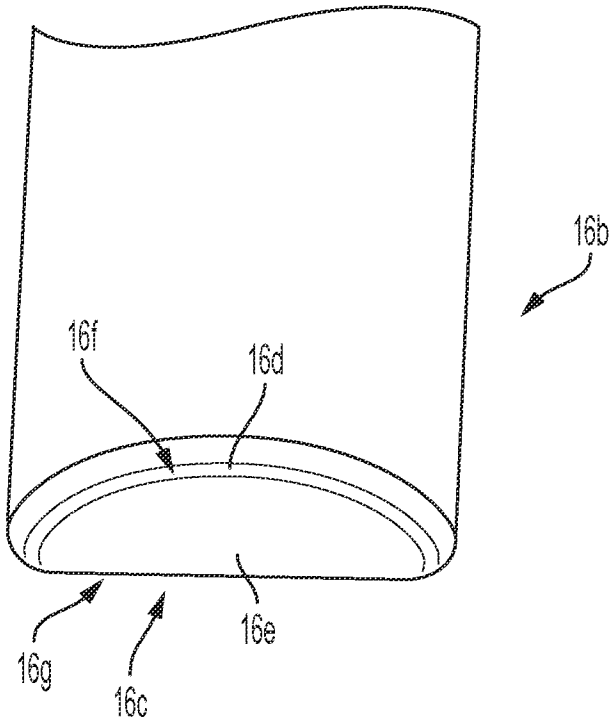
FIGS. 5*a* and 5*b* illustrate one of the punches of the coining assembly.
Figure 5A:
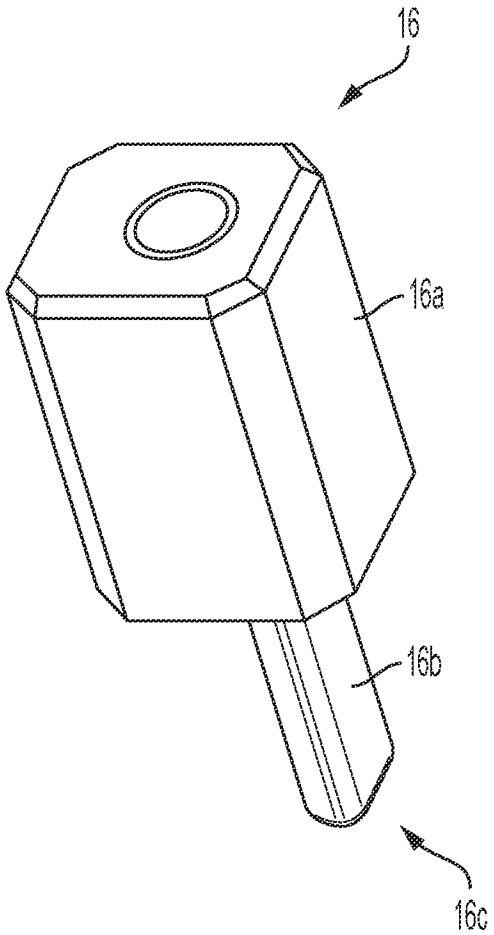

FIGS. 5*a* and 5*b* illustrate upper punch 16, but it should be understood that lower punch 18 is configured in the same manner as upper punch 16. Arms 16*b*, 18*b* each include a respective radiused tip 16*c*. 18*c* such that when punching a metal part, the material displaces outwards instead of a shearing action that a normal pierce punch provides. By radiused, it is meant that outer edges 16*d*, 18*d* of tip 16*c*, 18*c* are rounded. A center 16*e*, 18*e* of each tip 16*c*, 18*c* is flat. Each of tips 16*c*, 18*c* has a semi-circular perimeter. For example, as shown in FIG. 5*b*, tip 16*c* includes a curved edge 16*f* and a straight edge 16*g* connecting the ends of the curved edge 16*f*. Both edges 16*f*. 16*g* rounded.

FIGS. 2*a* to 2*d* illustrate the coining of a metal part 44 to form a coined metal part 45. FIG. 3*a* shows metal part 44 and FIG. 3*b* shows coined metal part 45. Prior to coining, the metal part 44 includes an upper surface 46, a lower surface 48 and a side edge 50 extending from the upper surface 46 to the lower surface 48. The upper surface 46 and the side edge 50 define an upper corner 52 of the metal part 44, and the lower surface 48 and the side edge 50 define a lower corner 54 of the metal part 44. Before coining, side edge 50 is approximately perpendicular (+/−5%) to upper and lower surfaces 46, 48, forming approximately right angles (+/−% 5) at the corners 52, 54.

Figure 2A:
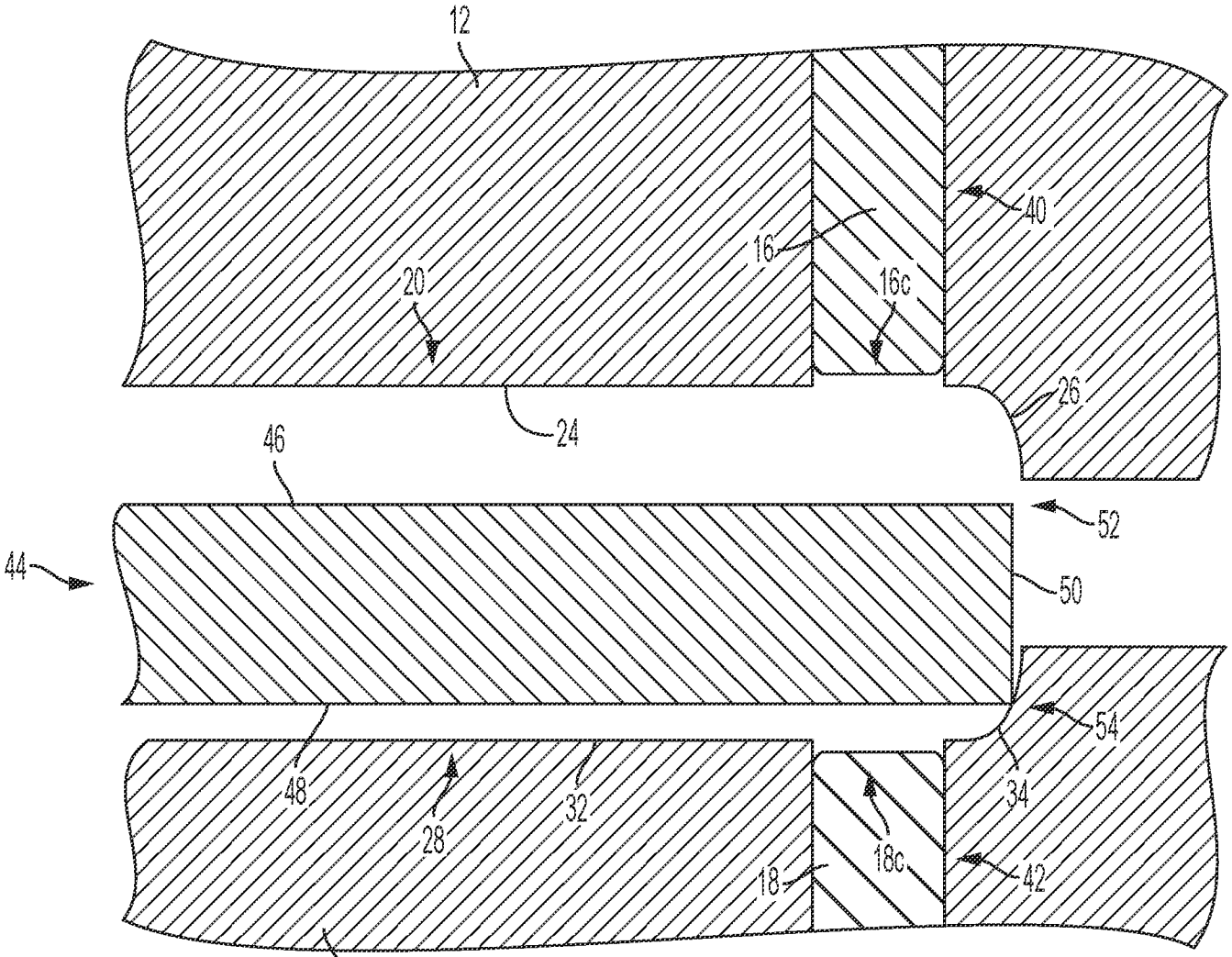
FIGS. 2*a* to 2*d* show the steps of a method for coining a metal part with the coining assembly according to the present disclosure.
Figure 3A:
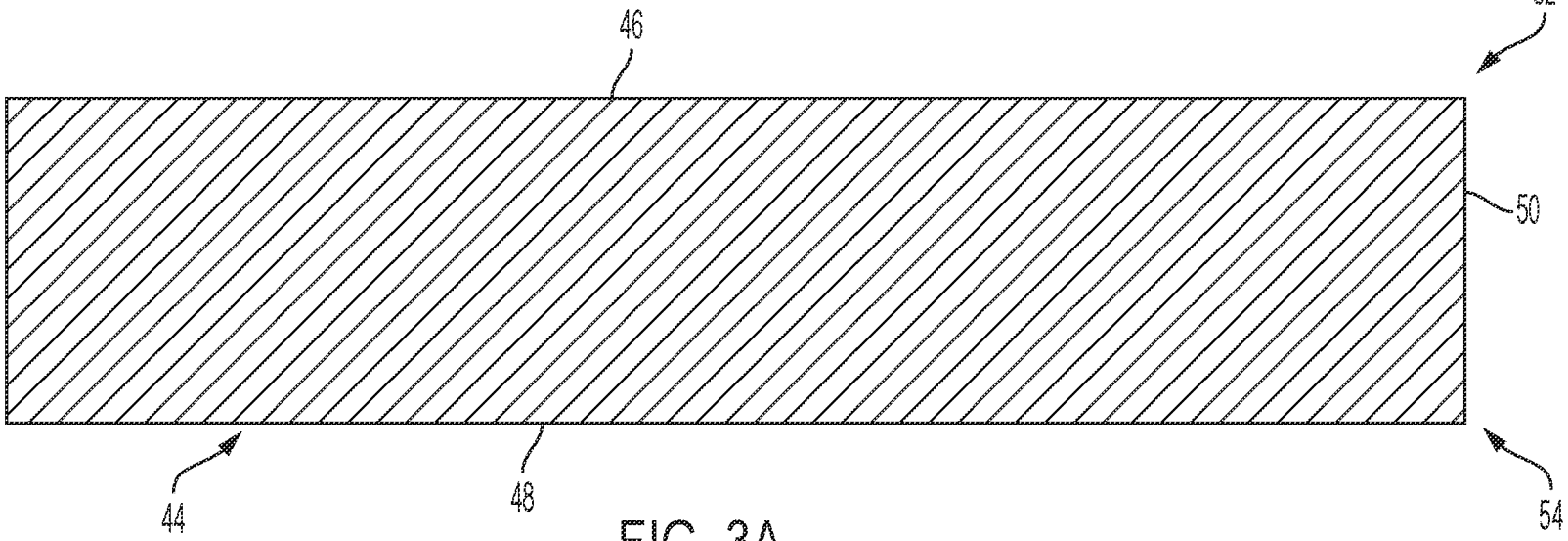
FIG. 3*a* shows the metal part prior to the coining operation.
Figure 3B:
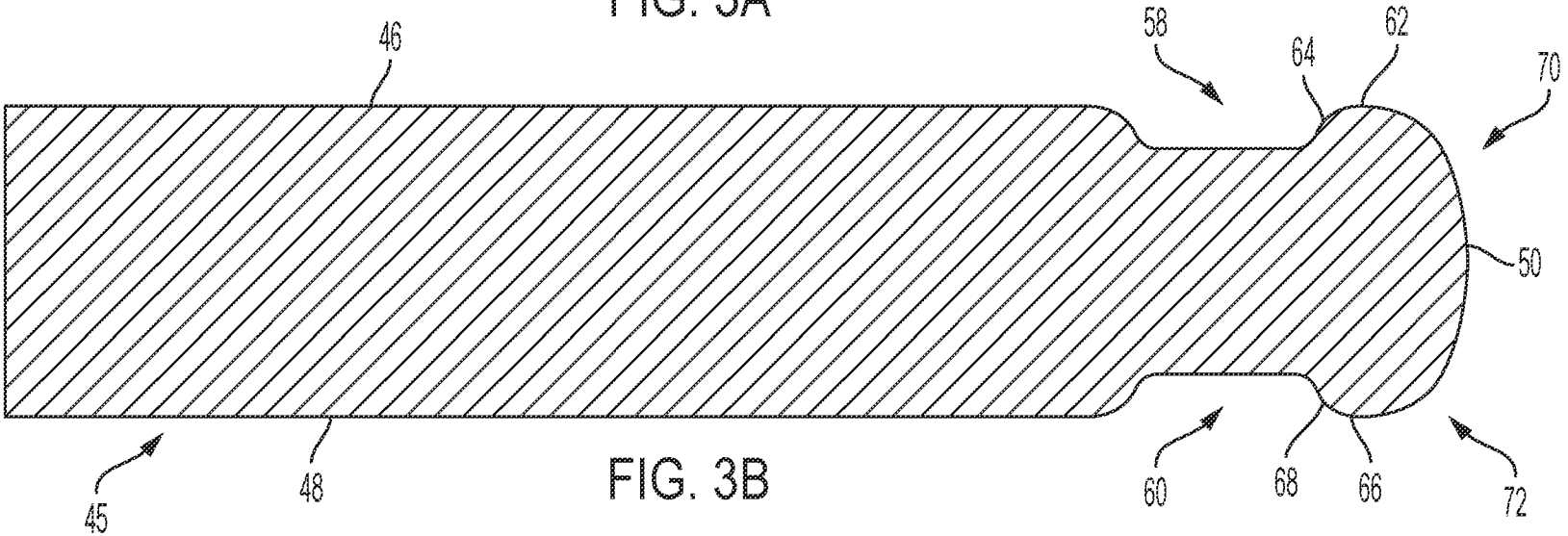
FIG. 3*b* shows the metal part after the coining operation.

As shown in FIG. 2*a*, metal part 44 can be placed within recess 28 of lower die 14 with lower corner 54 contacting concave surface 34 of lower die 14. As an alternative, metal part 44 can be held between upper die 12 and lower die 14 by a support.

The first surface 24 of recess 20 of the upper die 12 is parallel to and vertically spaced apart from upper surface 46 of metal part 44 and the first surface 32 of recess 28 of lower die 14 is parallel to and vertically spaced apart from lower surface 48 of metal part 44. Upper corner 52 of metal part 44 is vertically aligned with concave surface 26 of upper die 12 and lower corner 54 of metal part 44 is vertically aligned with concave surface 34 of lower die 14. Tip 16*c* of upper punch 16 is within stepped bore 40 of upper die 12, such that tip 16*c* is vertically above first surface 24 of recess 20. Similarly, tip 18*c* of lower punch 18 is within stepped bore 42 of lower die 14, such that tip 18*c* is vertically below first surface 32 of recess 28.

Figure 2B:
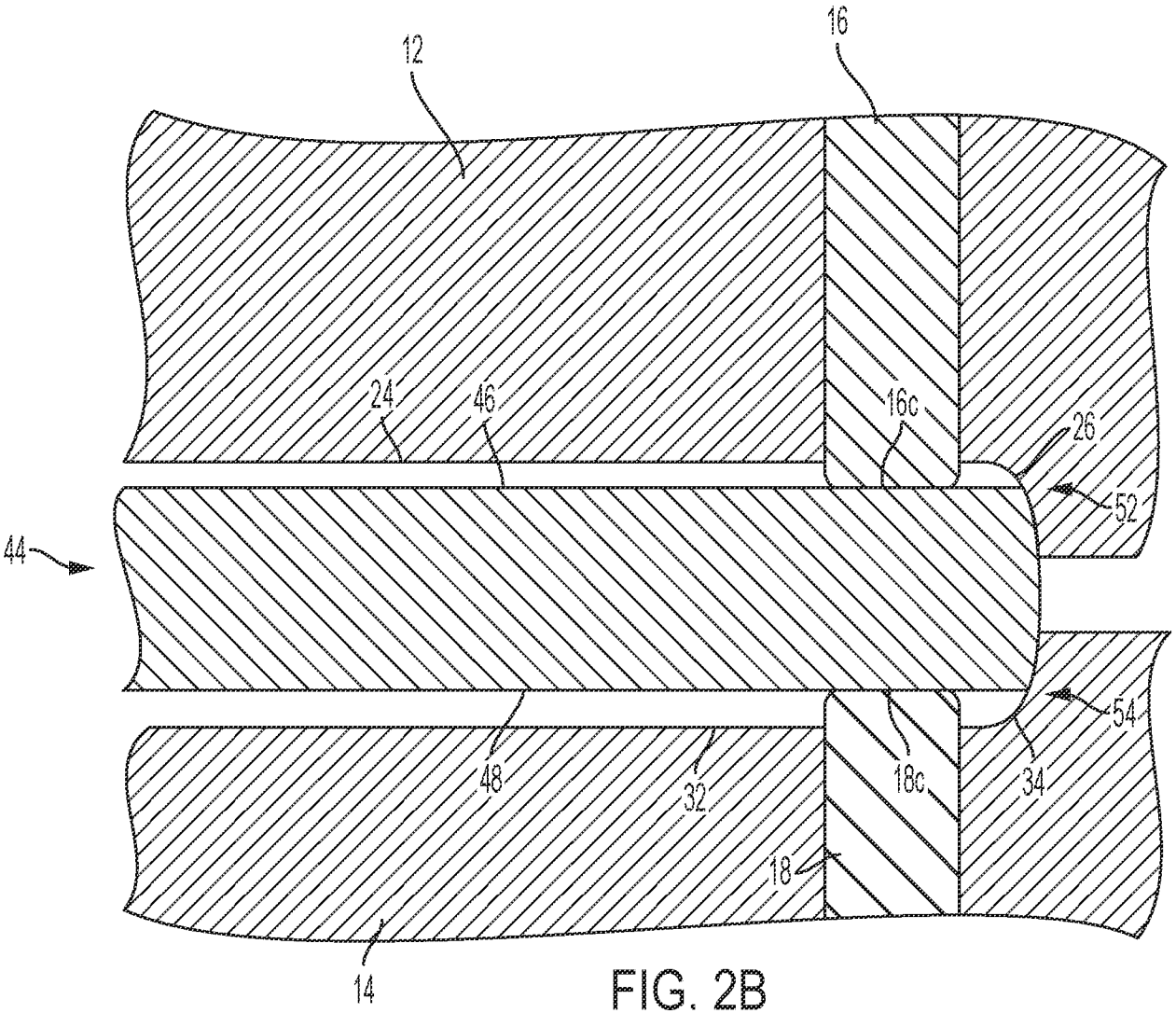

From the view in FIG. 2*a* to the view in FIG. 2*b*, tips 16*c*, 18*c* of punches 16, 18 have extended outside of the respective bore 40, 42 and the upper punch 16 is moved vertically downward in the stepped bore 40 of the upper die 12, while the lower die 14 is moved vertically downward to cause the stepped bore 42 of the lower die 14 to move with respect to the lower punch 18. More specifically, upper die 12 is moved downward, with a vertical gap being present between the upper support plate 41 and upper die 12 until the force of spring 13 (FIG. 1) pulls support plate 41 and upper punch 16 downward, causing tip 16*c* of upper punch 16 to move into recess 20 and then into contact with upper surface 46 of metal part 44. The downward movement of upper die 12 leads to upper die 12 contacting metal part 44 and pressing metal part 44 downward, which forces lower die 14 downward. Spring 15 (FIG. 1), which is spacing lower die 14 from lower support plate 43, is then compressed by the downward movement of lower die 14, causing bore 42 to move downward until the tip 18*c* of punch 18 moves into recess 28 and then into contact with lower surface 48 of metal part 44.

More specifically, tip 16*c* is moved below first surface 24 of upper die 12 and tip 18*c* is moved above first surface 32 of lower die 14. In the view shown in FIG. 2*b*, tip 16*c* has entered into contact with upper surface 46 of metal part 44 and tip 18*c* has entered into contact with lower surface 48 of metal part 44. As tips 16*c*, 18*c* contact surfaces 46, 48 of metal part 44, concave surfaces 26, 34 contact corners 52, 54 of metal part 44. The upper punch 16 contacts the upper surface 46 of the metal part 44 a non-zero lateral distance from the side edge 50 and the lower punch 18 contacts the lower surface 48 of the metal part 44 a non-zero lateral distance from the side edge 50. First surface 24 of upper die 12 is spaced from upper surface 46 of metal part 44 and first surface 32 of lower die 14 is spaced from lower surface 48 of metal part 44.

Figure 2C:
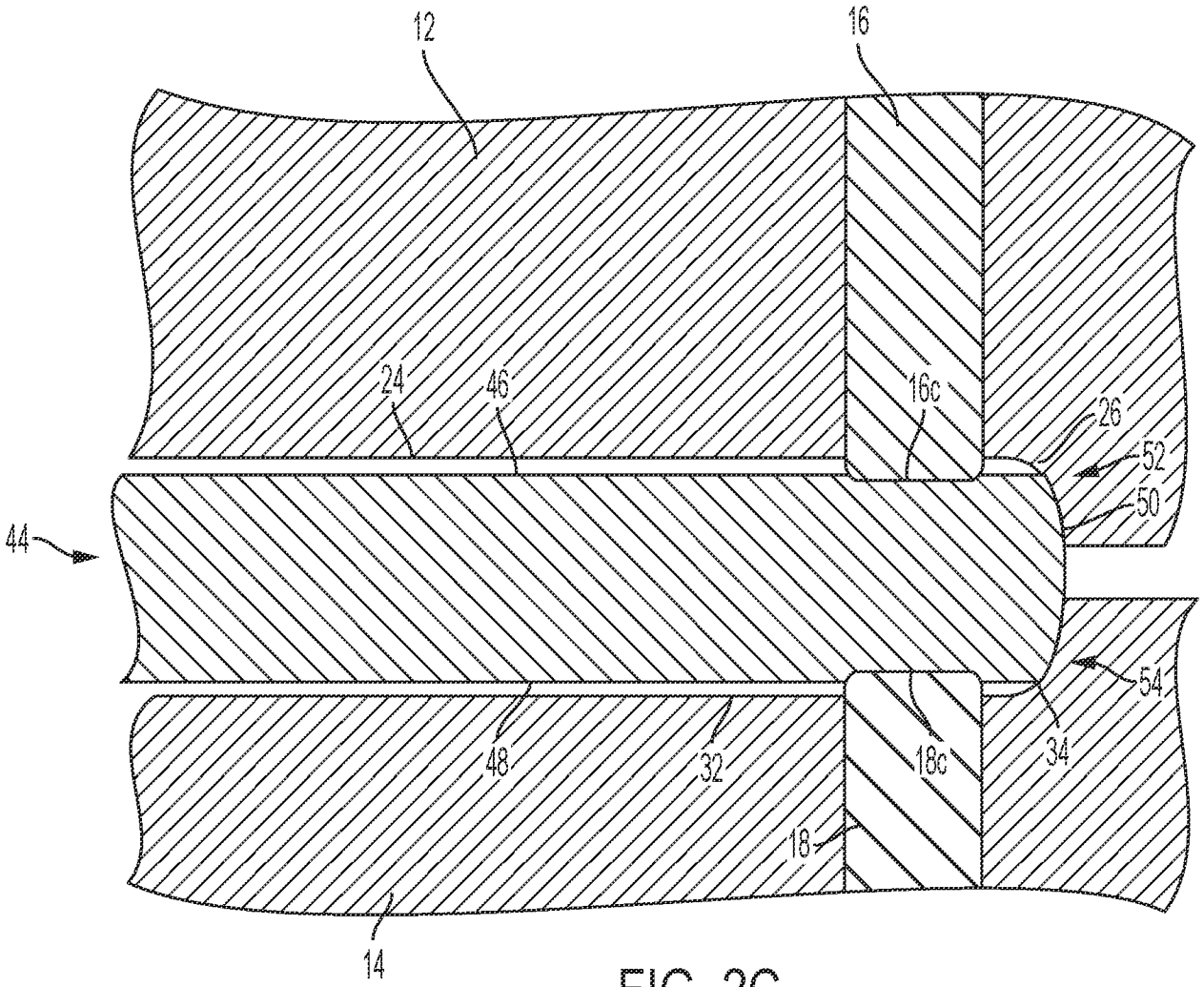

From the view in FIG. 2*b* to the view in FIG. 2*c*, upper punch 16 has moved further downward into upper surface 46 of metal part 44, deforming a portion of upper surface 46 downward, causing upper corner 52 and an upper portion of side edge 50 of metal part 44 to move outward away from upper punch 16 into concave surface 26. Metal part 44 also moves further downward into lower punch 18, deforming a portion of lower surface 48, causing lower corner 54 and a lower portion of side edge 50 of metal part 44 to move outward away from lower punch 18 into concave surface 34.

Figure 2D:
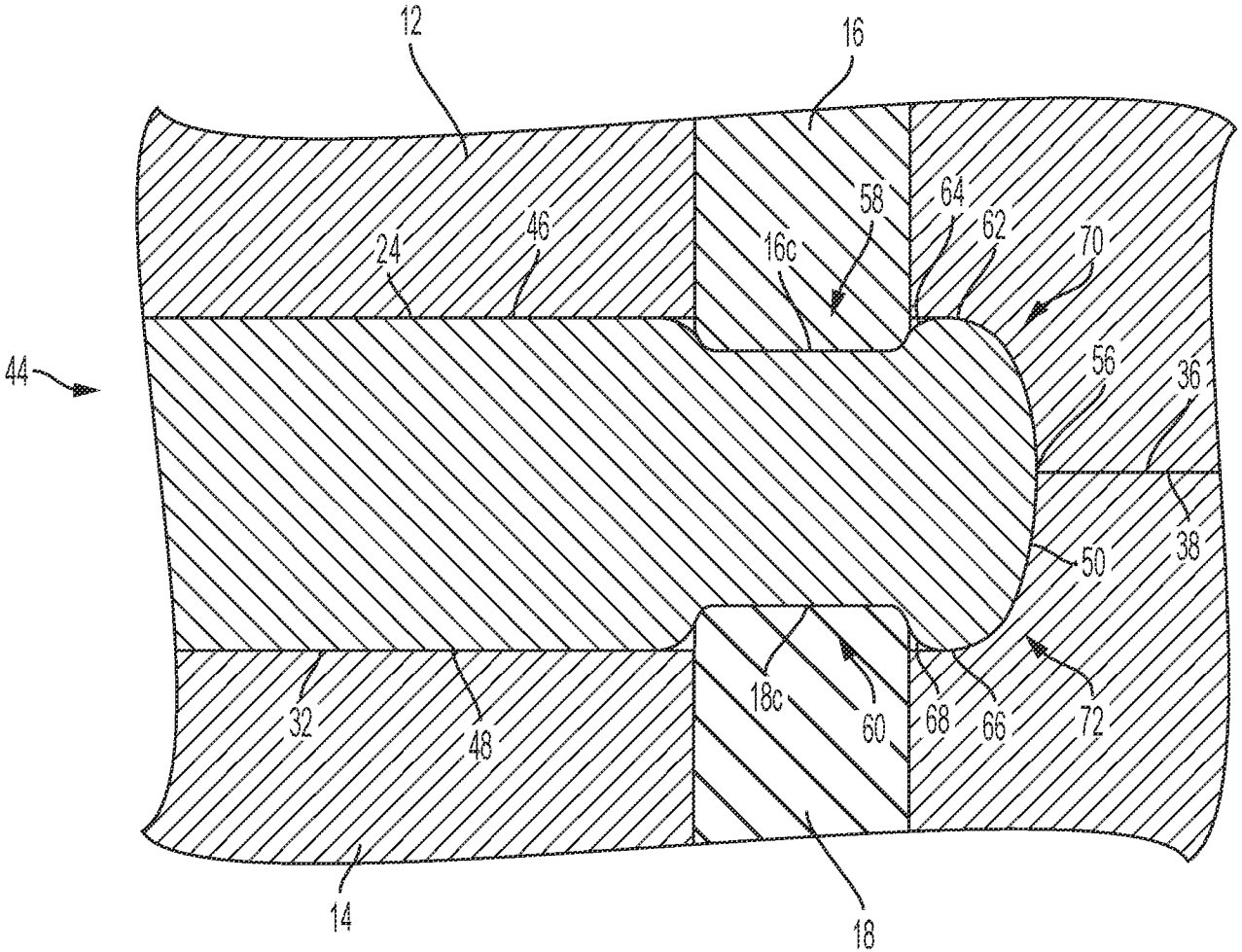

From the view in FIG. 2*c* to the view in FIG. 2*d*, upper punch 16 has moved further downward into upper surface 46 of metal part 44, further deforming the portion of upper surface 46 downward and completing the coining operation. Similarly, metal part 44 has moved further downward into lower punch 18, further deforming the portion of lower surface 48. First surface 24 of upper die 12 contacts upper surface 46 of metal part 44, first surface 32 of lower die 14 contacts lower surface 48 of metal part 44, and flat section 36 of upper die 12 contacts flat section 38 of lower die 14. Flat sections 36, 38 contact each other during the deformation of side edge 50 to prevent any of side edge from entering in between flat sections 36, 38, which would form burrs on coined metal part 45. As or after flat sections 36, 38 contact each other, side edge 50 is deformed into a contact edge 56 of dies 12, 14 where flat sections 36, 38 meet each other.

In the view shown in FIG. 2*d*, upper punch 16 is at the bottommost travel position and upper punch 16 has formed an indentation 58 in upper surface 46 of metal part 44, while metal part 44 is at the bottommost travel position and lower punch 18 has formed an indentation 60 in lower surface 48 of metal part 44, completing the punching step and the coining operation.

Figure 4B:
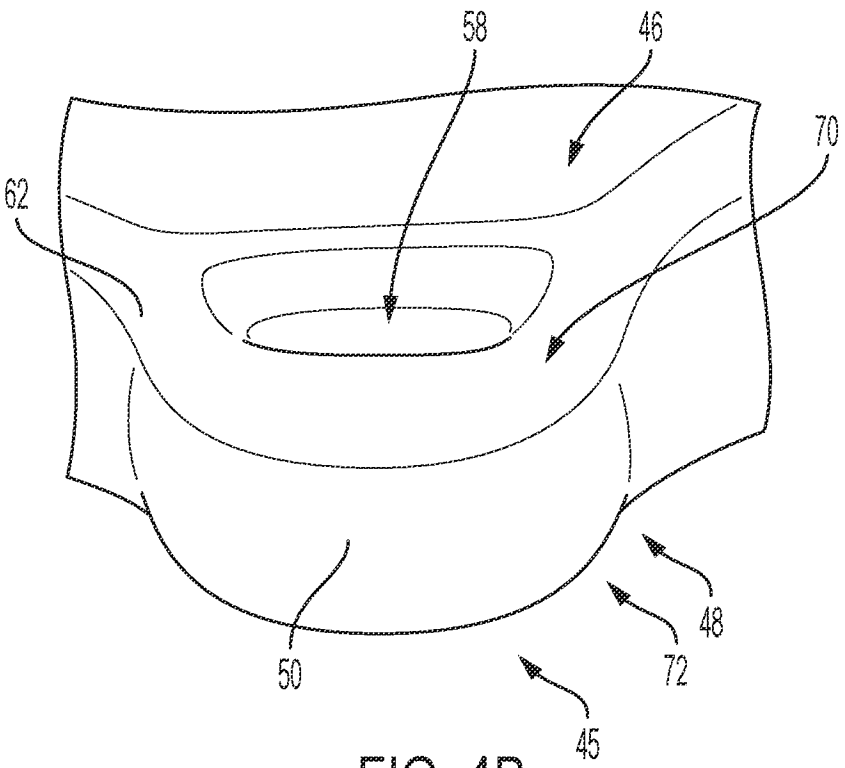
FIG. 4*b* shows a perspective view of the metal part after the coining operation.
Figure 4A:
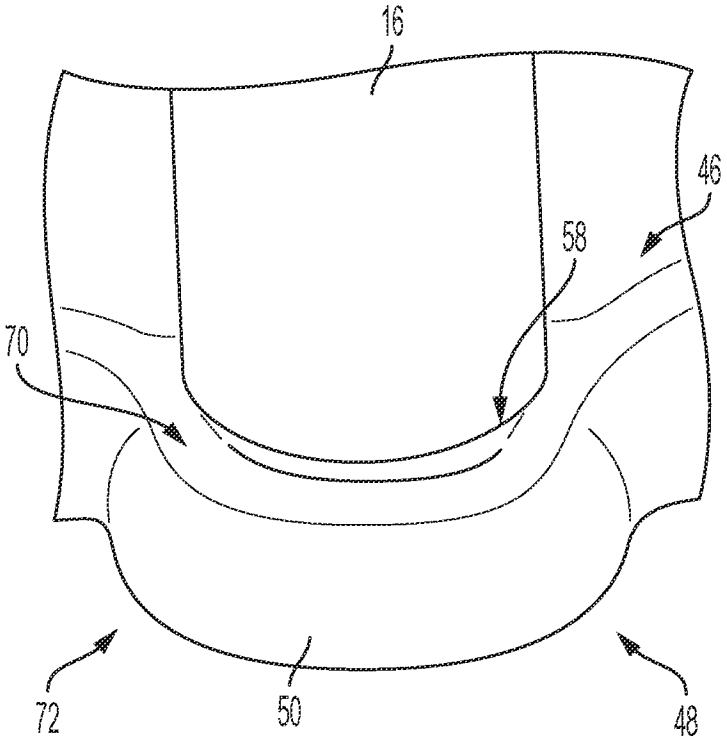
FIG. 4*a* shows a perspective view of the upper punch of the coining assembly in the bottommost position, with outer parts of the coining assembly omitted for clarity.

FIG. 4*a* shows a perspective view of upper punch 16 at the bottommost travel position. As discussed above with respect to FIG. 5*b*, tip 16*c* of upper punch 16 has a semi-circular perimeter, and the indentation 58 by upper punch 16 has a semi-circular perimeter. The side edge 50 has a curved shape when extending in a plane that is parallel upper surface 46 and lower surface 48 of metal part 44.

Coined metal part 45 is shown in FIG. 3*b* and FIG. 4*b* after the coining operation. After the punching step, the side edge 50 has a convex shape. A top of the side edge 50 defines an upper peak 62 and the upper surface 46 further includes a downwardly sloped surface section 64 extending from the upper peak 62 to the indentation 58 in the upper surface 46, and a bottom of the side edge 50 defines a lower peak 66 and the lower surface 48 further includes an upwardly sloped surface section 68 extending from the lower peak 66 to the indentation 60 in the lower surface 48.

During the punching step, the upper punch 16 contacts the upper surface 46 of the metal part 44 and deforms the upper portion of the metal part, which includes the upper corner 52 and part of side edge 50, into the concave surface 26 of the upper die 12 to convert the upper corner 52 into an upper rounded surface 70. Similarly, the lower punch 18, during the punching step, contacts the lower surface 48 of the metal part 44 and deforms the lower portion of the metal part 44, which includes the lower corner 54 and part of side edge 50, into the concave surface 34 of the lower die 14 to convert the lower corner 54 into a lower rounded surface 72. As a result, the side edge 50 of the metal part 44 takes on a convex shape, such as a semi-oval shape. The indentations 58, 60 are spaced apart from side edge 50, with each indentation 58, 60 being separated by a non-zero lateral distance from the side edge 50.

In the preceding specification, the present disclosure has been described with reference to specific exemplary embodiments and examples thereof. It will, however, be evident that various modifications and changes may be made thereto without departing from the broader spirit and scope of the present disclosure as set forth in the claims that follow. The specification and drawings are accordingly to be regarded in an illustrative manner rather than a restrictive sense.

LIST OF REFERENCE NUMBERS

10 coining assembly
12 upper die
14 lower die
16 upper punch
16*a* base
16*b* arm
16*c* tip
16*d* outer edges
16*e* center
16*f* curved edge
16*g* straight edge
18 lower punch
18*a* base
18*b* arm
18*c* tip
18*d* outer edges
18*e* center
20 recess
22 lower surface
24 first surface

26 concave surface
28 recess
30 upper surface
32 first surface
34 concave surface
36 flat sections
38 flat sections
40 stepped bore
40*a* upper wider section
40*b* lower narrower section
41 plates
42 stepped bore
42*a* upper wider section
42*b* lower narrower section
43 plates
44 metal part
45 coined metal part
46 upper surface
48 lower surface
50 side edge
52 upper corner
54 lower corner
56 contact edge
58 indentation
60 indentation
62 upper peak
64 downwardly sloped surface section
66 lower peak
68 upwardly sloped surface section
70 upper rounded surface
72 lower rounded surface

What is claimed is:

1. A method of coining a metal part, the method comprising:

positioning the metal part between an upper die and a lower die, an upper punch being positioned within the upper die, a lower punch being positioned within the lower die; and a punching step including punching an upper surface of the metal part with the upper punch to cause an upper portion of the metal part to deform into a concave surface of the upper die, and punching a lower surface of the metal part with the lower punch to cause a lower portion of the metal part to deform into a concave surface of the lower die, the punching step, after completion, resulting in an indentation in the upper surface of the metal part and an indentation in the lower surface of the metal part, the metal part including a side edge extending from the upper surface to the lower surface, the upper surface and the side edge defining an upper corner of the metal part, the lower surface and the side edge defining a lower corner of the metal part, the upper portion of the metal part deformed into the concave surface of the upper die during the punching step including the upper corner of the metal part, the lower portion of the metal part deformed into the concave surface of the lower die during the punching step including the lower corner of the metal part, during the punching step:

the concave surface of the upper die contacts the upper corner of the metal part as the upper punch begins to penetrate into the upper surface of the metal part, and the concave surface of the lower die contacts the lower corner of the metal part as the lower punch begins to penetrate into the lower surface of the metal part.

2. The method as recited in claim 1 wherein the upper die includes a recess formed in a lower surface of the upper die, the recess of the upper die including a first surface contacting the upper surface of the metal part, the recess of the upper die also including the concave surface;

wherein the lower die includes a recess formed in an upper surface of the lower die, the recess of the lower die including a first surface contacting the lower surface of the metal part, the recess of the lower die also including the concave surface.

3. The method as recited in claim 2 wherein the concave surface of the recess in the lower surface of the upper die extends to a flat section of the lower surface of the upper die, wherein the concave surface of the recess in the upper surface of the lower die extends to a flat section of the upper surface of the lower die, wherein, during the punching step:

the flat section of the lower surface of the upper die and the flat section of the upper surface of the lower die contact each other as the upper surface of the metal part is contacted with the upper die and the lower surface of the metal part is contacted with the lower die.

4. The method as recited in claim 3 wherein, during the punching step:

as or after the flat sections of the upper die and the lower die contact each other, a side edge of the metal part is deformed into a contact edge of the lower and upper dies where the flat sections meet each other.

5. The method as recited in claim 2 wherein the upper punch extends into the recess formed in the lower surface of the upper die during the punching step and the lower punch extends into the recess formed in the upper surface of the lower die during the punching step.

6. The method as recited in claim 5 wherein the upper die includes a stepped bore formed therein receiving the upper punch, the upper punch being moved vertically downward in the stepped bore of the upper die during the punching step, wherein the lower die includes a stepped bore formed therein receiving the lower punch, the lower die being moved vertically downward to cause the stepped bore of the lower die to move with respect to the lower punch during the punching step.

7. The method as recited in claim 6 wherein the upper punch includes a base and a punching arm having a lesser width than the base extending downward from the base, the punching arm of the upper punch deforming the upper surface of the metal part during the punching step, wherein the lower punch includes a base and a punching arm having a lesser width that the base extending downward from the base, the punching arm of the lower punch deforming the lower surface of the metal part during the punching step.

8. The method as recited in claim 7 wherein the punching arm of the upper punch includes a tip having rounded outer edges, the tip of the punching arm of the upper punch deforming the upper surface of the metal part during the punching step, wherein the punching arm of the lower punch includes a tip having rounded outer edges, the tip of the punching arm of the lower punch deforming the lower surface of the metal part during the punching step.

9. The method as recited in claim 1, wherein the upper portion of the metal part deformed into the concave surface of the upper die during the punching step further includes part of the side edge of the metal part, wherein the lower portion of the metal part deformed into the concave surface of the lower die during the punching step includes part of the side edge of the metal part.

10. The method as recited in claim 9 wherein, prior to the punching step, the upper corner and the lower corner are defined by approximately right angles and the side edge is approximately perpendicular to the upper surface and the lower surface of the metal, and after the punching step, the side edge has a convex shape.

11. The method as recited in claim 10 wherein the convex shape is a semi-oval shape.

12. The method as recited in claim 1, wherein the upper punch, during the punching step, contacts the upper surface of the metal part and deforms the upper portion of the metal part into the concave surface of the upper die to convert the upper corner into an upper rounded surface, wherein the lower punch, during the punching step, contacts the lower surface of the metal part and deforms the lower portion of the metal part into the concave surface of the lower die to convert the lower corner into a lower rounded surface.

13. The method as recited in claim 12 wherein, during the punching step:

the upper punch forms the indentation in the upper surface of the metal part and contact with the concave surface of the upper die shapes the upper rounded surface, and the lower punch forms the indentation in the lower surface of the metal part and contact with the concave surface of the lower die shapes the lower rounded surface.

14. The method as recited in claim 13 wherein a top of the side edge defines an upper peak and the upper surface further includes a downwardly sloped surface section extending from the upper peak to the indentation in the upper surface, and a bottom of the side edge defines a lower peak and the lower surface further includes an upwardly sloped surface section extending from the lower peak to the indentation in the lower surface.

15. The method as recited in claim 1, wherein, during the punching step, the upper punch contacts the upper surface of the metal part a non-zero lateral distance from the side edge and the lower punch contacts the lower surface of the metal part a non-zero lateral distance from the side edge.

16. The method as recited in claim 1 wherein the upper punch is fixed to an upper support plate that is vertically movable with respect to the upper die and the lower punch is fixed to a lower support plate, the lower die being vertically movable with respect to the lower support plate.

17. The method as recited in claim 16 wherein prior to the punching step the upper support plate is spaced from the upper die and the lower support plate is spaced from the lower die, and at an end of the punching step the upper support plate contacts the upper die and the lower support plate contacts the lower die.

* * * * *